United States Patent [19]

Bohnenkamp

[11] Patent Number: 4,751,837

[45] Date of Patent: Jun. 21, 1988

[54] METHOD AND APPARATUS FOR LEVEL CONTROL OF ROLLING MILL ROLLS

[75] Inventor: Heinrich Bohnenkamp, Neuss, Fed. Rep. of Germany

[73] Assignee: SMS Schloemann-Siemag Aktiengesellschaft, Dusseldorf, Fed. Rep. of Germany

[21] Appl. No.: 944,480

[22] Filed: Dec. 18, 1986

[30] Foreign Application Priority Data

Dec. 18, 1985 [DE] Fed. Rep. of Germany ..... 3544781

[51] Int. Cl.[4] ..... B21B 31/08; B21B 31/30

[52] U.S. Cl. ..... 72/239; 72/20; 72/244

[58] Field of Search ..... 72/244, 237, 238, 239, 72/243, 245, 20

[56] References Cited

U.S. PATENT DOCUMENTS

| | | | |
|---|---|---|---|
| 3,805,573 | 4/1974 | Petros et al. | 72/244 |
| 4,038,857 | 8/1977 | Eibe et al. | 72/244 |
| 4,237,715 | 12/1982 | Lutz | 72/244 |

FOREIGN PATENT DOCUMENTS

| | | | |
|---|---|---|---|
| 1752581 | 10/1973 | Fed. Rep. of Germany . | |
| 2806525 | 8/1979 | Fed. Rep. of Germany . | |
| 0087912 | 5/1974 | Japan | 72/244 |
| 5510340 | 1/1980 | Japan . | |

*Primary Examiner*—Robert L. Spruill
*Assistant Examiner*—Steven B. Katz
*Attorney, Agent, or Firm*—Karl F. Ross; Herbert Dubno

[57] ABSTRACT

A method and apparatus for height or level-positioning of rolls in rolling mill frames, for adapting the upper edge of the lower working roll to the rolling plane, and for changing the rolls, expecially in four-high mills equipped with a roll changing cart which can travel in the longitudinal direction of the rolls, and equipped with interchangeable shim plates of various individual thicknesses for supporting the holding elements of the support rolls. The apparatus affords an infinitely variable and continous adaptation to the wear of the rolls. The apparatus is operated such that the level or position of the individual shim plates is carried out infinitely variable by way of a short vertical stroke. The mill preferably includes a system of movable wedges which includes two upper wedges and two lower wedges.

7 Claims, 5 Drawing Sheets

METHOD AND APPARATUS FOR LEVEL CONTROL OF ROLLING MILL ROLLS

FIELD OF THE INVENTION

My present invention relates to a method of and an apparatus for positioning rolls in rolling mills and, especially, for controlling the height or level of such rolls.

More particularly, this invention relates to a method and apparatus for vertically positioning the rolls in rolling mill frames for alignment of the upper edge of the working roll with respect to the rolling plane and for changing of rolls.

The invention is applicable preferably to four-high rolling mills, but can be used to advantage for other mills. The apparatus utilizes a carriage, cart or dolly to change rolls with the cart traversing in the longitudinal direction of the respective roll, and raising or elevating movements are done with a plurality of shim plates elements which can support the holding elements or bodies for the rolls to be moved. The apparatus further includes lift elements which serve to temporarily support the holding elements.

BACKGROUND OF THE INVENTION

German Pat. No. 2,806,525 describes a device for extracting the rolls from rolling mill frames and for aligning of the top or top edge of the lower working roll with reference to the roll gap or plane. This prior art device is equipped with a roll changing cart on which are arranged several shim plates of distinct height.

By way of a drive unit the shim plates can be brought beneath the holding elements for the respective rolls. For such positioning, the shim plates are arranged on a shift frame which is movably guided on a track arranged on the roll change cart and which is connected to the drive unit. The drive unit includes at least one spindle which is journaled in the roll change cart and also includes a motor and a transmission for imparting motive power to the spindle.

The prior art apparatus further includes lift elements for supporting the holding elements, and these lift elements are arranged on each of the two sides of the shift frame in the roll change cart.

The prior art apparatus employs shim plates of various thicknesses, but does not allow for a step-less continuous alignment to alleviate problems of wear of the roll.

Step-less adjustable devices are known, and the maximum distance which can be traversed to adjust the respective height of the holding elements is controlled by way of wedges. However, this system does not permit displacement in the direction of the axes of the rolls. Due to the unnecessarily small wedge angle, the wedges, furthermore, need to be rather long, to avoid the possibility of jamming and like problems.

Accordingly, the prior art systems are undesirably bulky, are not very economical, and are prone to require a large amount of maintenance and space.

OBJECTS OF THE INVENTION

It is therefore the principal object of the present invention to provide a method and apparatus which obviate the mentioned disadvantages and problems of the prior art.

It is also an object to provide a method and apparatus which allows a simple exchange of respective rolls.

It is further an object of the invention to provide a method and apparatus with which a very precise adjustment of the roll gap and maintenance of the roll gap and/or rolling plane can be achieved.

In accordance with another object of the invention, the apparatus is compact and enhances the maintenance of the shim plates and lift elements without detrimentally affecting the respective frame components.

SUMMARY OF THE INVENTION

The foregoing and other objects and advantages of the invention are obtained in a method in which the height or elevation-positioning of individual shim plates is carried out so as to be infinitely variable by way of a short vertical stroke or lifting movement.

It is preferred that the motion is achieved by means of movement of respective wedges.

Thus, a very favorable step-less, level control is achieved and replacement of the rolls is possible with a minimal space requirement of the means for doing so.

The step-less height or level control allows a continuous adaptation of the upper limit or edge of the lower working roll to a roll plane which is constant with respect to elevation or height.

In accordance with a preferred embodiment, the short vertical stroke is produced by a horizontally directed stroke.

This is also conducive to a compact structure in which the short vertical lift or movement is produced by a relatively short horizontal stroke.

It is also preferred that in the case of several shim plates of different heights, commencing with the lowest stage, these are respectively elevated in a step-less manner by means of the mentioned short vertical stroke, until the lowest stage has reached the level of the next higher stage.

The vertical lift elements then temporarily take over the support of the holding elements until the short vertical stroke is retracted to its lower position and the next higher shim plate has been positioned beneath the respective holding elements.

Accordingly, a continuous control or adaptation of the upper limit of the lower working roll with respect to the roll gap or roll plane, for example for hot roll mills, is achieved.

A fixed roll table or surface and respectively a fixed upper guide edge in conformity with the thickness of the respective strip product can be selectively established.

Advantageously the method is applied in the replacement of respective rolls, such as for changing of the working rolls, whereby the lower support roll is lifted with the respective working roll. This is done by way of the vertical lift elements in the rol changing cart, and the lowermost shim plate is moved beneath the holding elements. The support roll is then lowered with the working roll, whereby the lower holding element of the working rolls is seated on a fixed rail and is then driven out or extracted.

This operation facilitates the procedure for replacement of the rolls, in which the respective extraction rails need not be elevated for the exchange operation.

The apparatus of the invention thus can have a roll-changing cart which is provided with a movable wedge system for the step-less height control or positioning of the individual shim plates.

It is also preferred that the wedge system is comprised of two upper wedges and two lower wedges, with respectively one upper and one lower wedge member forming a common contact surface, and the upper member is positively guided in the vertical direction, but the lower member is positively guided in the horizontal direction.

According to another feature of the invention, the respectively lowermost wedges are rigidly connected to one another by one or more connecting elements, thereby affording an economic advantage for the apparatus which is operative with fewer shim plates.

According to yet another feature of the invention the surface contact of the respective upper wedge or wedges with the respective lower wedge or wedges is effected at an angle of about 5° with respect to the horizontal plane, thereby ensuring an especially compact construction.

The respective lower wedges can be horizontally shiftable by means of a lifting cylinder. The lifting cylinder is preferably arranged between the lower wedges.

The piston and cylinder units for carrying out the lifting movement are time-tried elements and their arrangement between the wedges is particularly space-conserving.

It is also advantageous to arrange a protective clamp or damper at the piston rod for the horizontally acting lifting cylinder, so as to absorb the impact experienced during rolling on the piston and cylinder unit.

At least one upper wedge is equipped with a pressure sensor and has a space piece or similar spacer to control the rolling pressure and to maintain a constant height of the rolling plane in controlled and/or selective manner.

Several plates with varying thicknesses can be arranged on the roll-changing dolly or cart, and by means of a shifting drive these can be positioned beneath the holding elements for the lower support roll.

Accordingly, the shim plates can be arranged in a shift frame which is movably guided on tracks arranged on the roll changing cart, and the frame is connected to the shifting drive. The shifting drive can include at least one spindle, such as a screw spindle, which is journaled in the roll changing cart and powered by a motor, e.g. via a transmission.

This embodiment allows selective control and adjustment of the level or elevation of the rolls, for example, continuously as a function of the wear of the roll.

The vertical lift elements for temporarily supporting the mounting elements are preferably arranged on either one of the two sides of the shift frame in the roll changing cart.

It is further advantageous that gradation of the individual shim plates with respect to one another is by increments of approximately 30 mm.

Furthermore, the lower or smallest-height shim plates can have a thickness of approximately 50 mm, and between the mill frame portions are arranged respective exit rails, arranged on both sides in axis-parallel manner with respect to the rolls and in stationary manner. The lower holding elements of the working rolls can be moved on the exit rails as long as the holding elements of the support roller are resting on the lower support shim plates.

This embodiment allows a preferred roll replacement without the need for lifting or elevating the exit rail for the replacement operation.

BRIEF DESCRIPTION OF THE DRAWING

The above and other objects, features and advantages of the present invention will become more readily apparent from the following description, reference being made to the accompanying highly diagrammatic drawing in which.

SPECIFIC DESCRIPTION

Figure 1:
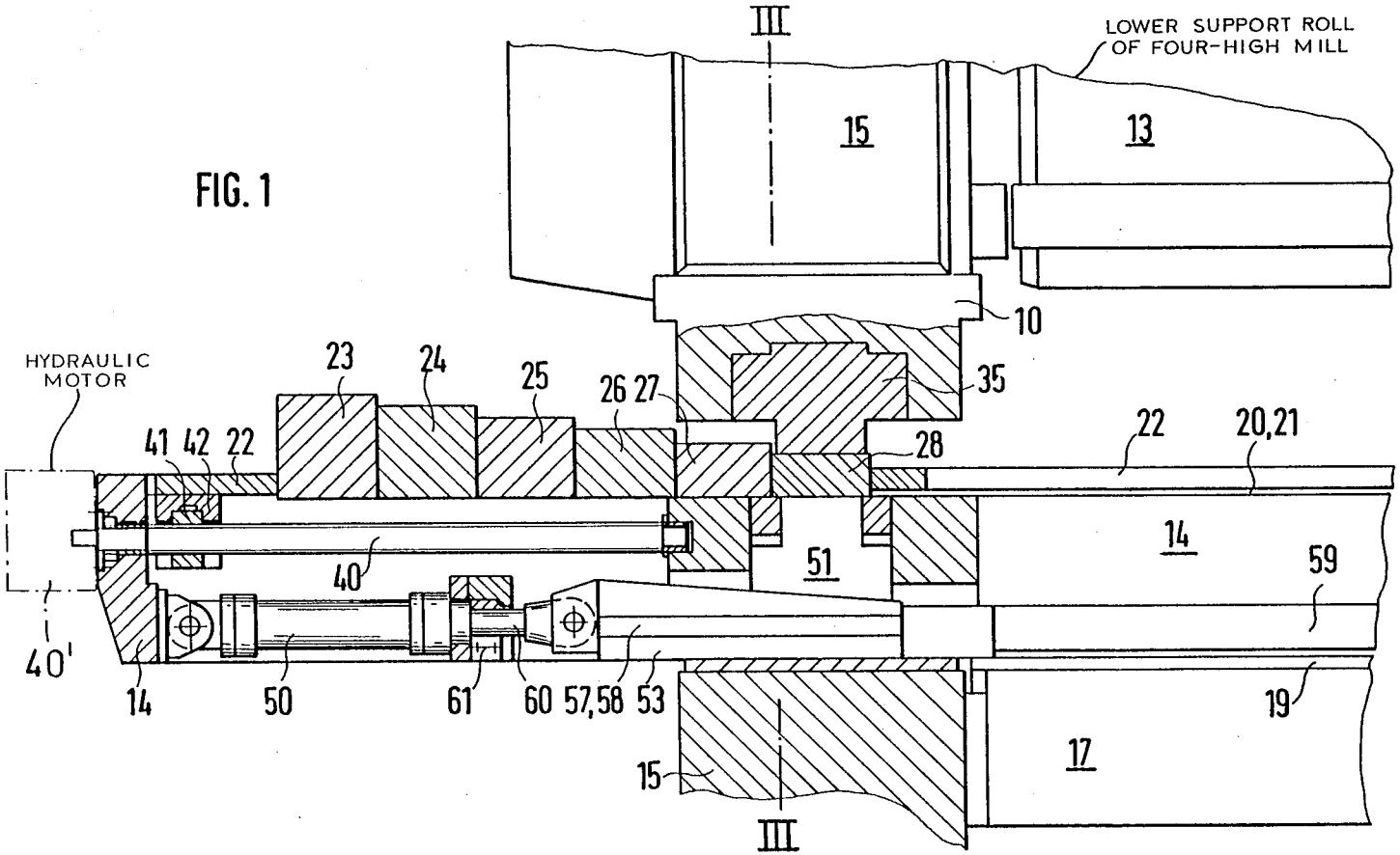
FIG. 1 is a partial cross-sectional view through the roll change cart in the region of the left holding element of a rolling mill frame.
Figure 2:
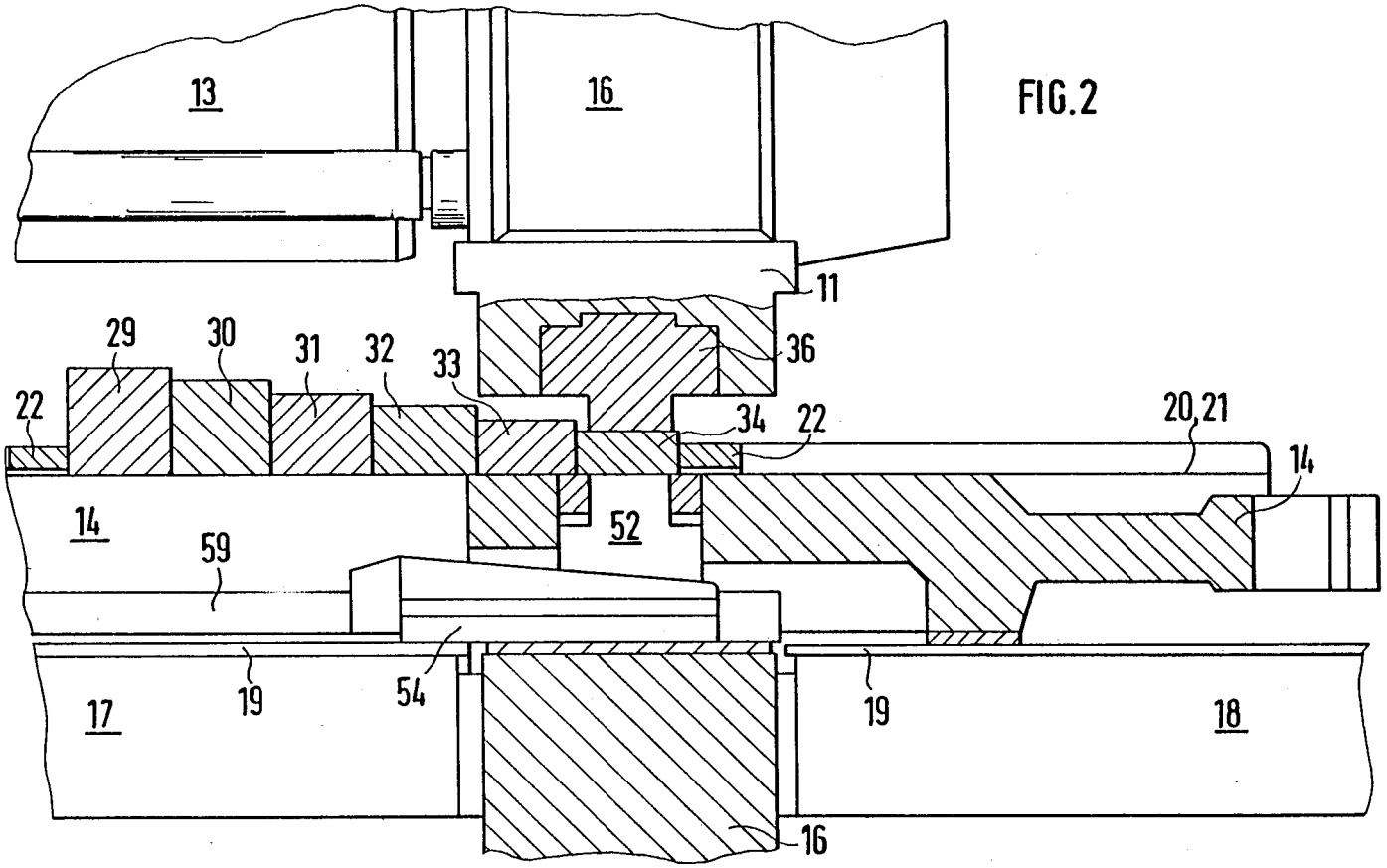
FIG. 2 is a partial longitudinal section through the roll change cart in the region of the right holding element of the rolling mill frame.

FIGS. 1 and 2 respectively show portions of a four-high rolling mill with holding elements 10 and 11 in the respective window-like openings of the frame portions 15 and 16 of the mill. The holding elements 10 and 11 carry a lower support roll 13 for the rolling operation, and they are arranged on a roll-changing carriage, dolly or cart 14.

The frame portions or components 15 and 16 are connected by a girder or traverse 17 with an additional support 18 being provided at the frame component 16. A slide bar 19 is arranged and aligned at the frame components 15 and 16, at the traverse 17, and the support 18, and the roll changing cart 14 can slide or traverse on this slide bar 19. The piston rod 84 of an actuating piston and cylinder unit 85 (FIG. 4), is connected at the roll changing cart 14, so that the cart 14, can be moved on the slide bar 19 into and out of the frame arrangement.

The upper portion of the cart 14 is equipped with guide rails or similar guides 20 and 21 for a shift frame 22 in which are disposed six shim plates 23 to 28 (right), and 29 to 34 (left), respectively. Each shim plate is of specific height, and the shim plates are serially arranged, one behind the other, according to height. The lowest shim plates (28 and 34) have a thickness of approximately 50 mm.

Thus, the roll changing device, cart or dolly 14 can be easily used to effect the exchange or replacement of working rolls. As well, the lower support roll 13 can be raised by way of the vertical lift elements (FIG. 3), reference numerals 70 (left) and 71 (right).

The lowest shim plates (28 and 34) can be moved beneath the holding elements 10 and 11 whereupon the support roll 13 can be lowered together with the associated working roll (not shown). The lowermost holding elements of the working roll are then supported on a fixed or exit rail 86 (FIG. 4), and can then be extracted or driven out. When it is additionally required to exchange the support rolls (13), these are then subsequently driven out or extracted on the dolly 14.

The steps between the other shim plates (23 to 27; and 29 to 33) with respect to one another, are in stages of approximately 30 mm. The shim plates (i.e. the pairs 23, 29; 24, 30; 25, 31; 26, 32; 27, 33; and 28, 34) are arranged to cooperate in paired relationship and with the respective hardmetal pressure pieces 35 (left) and 36 (right).

The guide rails 20 and 21 of the shift frame 22 can be protected by covers, not shown in detail, which are arranged laterally at the cart 14, with the covers being connected by means of seals, also not shown, at the holding elements 10 and 11. This precludes the entry of dirt which could affect the shim plates (23 to 34) in their guide rails 20 and 21.

The drive unit for the system is generally provided by a spindle 40 journaled at the roll changing cart 14. The spindle 40 can be driven by way of a bevel gear transmission system, bevel gears, and a motor, e.g. an electric or a hydraulic motor 40.

A guide screw 41 is provided on the spindle 40 and this screw 41 moves the shift frame 22 by way of a fork or clevis 42 secured at the shift frame 22.

A horizontally disposed piston and cylinder unit 50 is also arranged in the shift frame 22, and this piston and cylinder unit 50 can actuate the moveable wedge system (51 to 54) for the infinitely-variable height control of the individual shim plates (23 to 34) as respectively disposed beneath the respective hardmetal pressure piece (35 and 36).

The wedge system (51 to 54) is generally comprised of two upper wedges 51 (left - FIG. 1) and 52 (right - FIG. 2) and two lower wedges 53 and 54. The upper wedges (51, 52) are dependently moved in vertical direction, and the lower wedges (53, 54) are dependently moved in horizontal direction.

For the lower wedges 53 and 54, the dependency arises through the wedge-type rails or formations 55 and 56 which are movably disposed in the guide grooves 57 and 58 (FIG. 3) of the roll change cart 14. The upper wedges 51 and 52 can be moved in vertical direction in the frame of the roll changing dolly 14.

It is preferred that the lower wedges 53 and 54 are connected to one another by a connecting element 59, for example, one or more rods, profile strips, rod structures, or the like.

A hydraulic clamp 61 is provided at the piston rod 60 of the horizontal piston and cylinder unit 50, and this clamp or protecting means e.g. a damper 61 precludes that the piston and particularly the piston rod 60 will be damaged by the operation of the unit.

Figure 3:
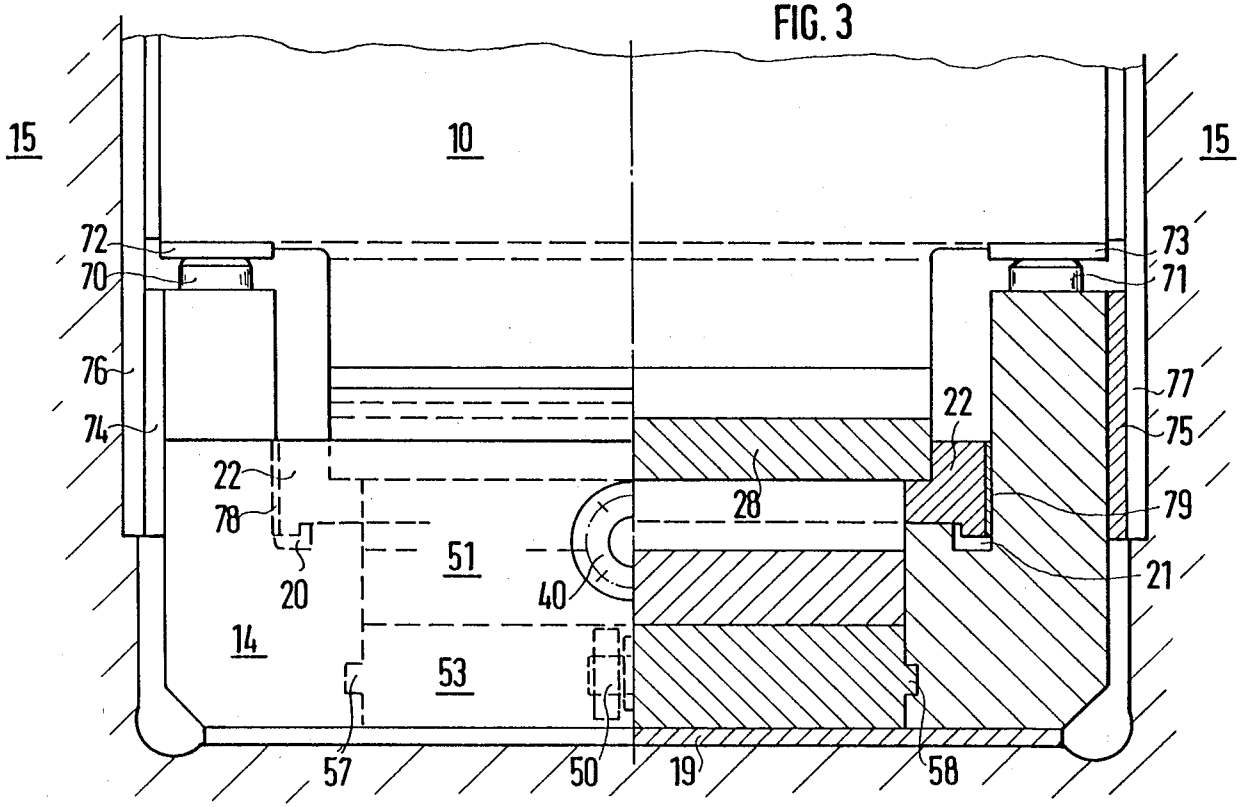
FIG. 3 is a transverse cross-section along line III—III of FIG. 1.

With reference to FIG. 3, vertically disposed piston and cylinder units, one on each of the two shown sides of the shift frame 22 in the cart 14, provide the functions of the lift elements 70 (left) and 71 (right). These units are arranged beneath the holding elements 10 and 11. The respective pistons, on being pressurized, can lift the holding elements 10 and 11 by way of respective spacer plates 72 and 73.

The cart 14 is supported by lateral slide plates 74 (left) and 75 (right) which are arranged at the respective wear bars 76 (left) and 77 (right) of the frame components 15, and 16 respectively. Thus, the cart 14 is moveable in axis-parallel direction while being laterally supported.

The shift frame 22, in turn, is moved in the cart 14 and laterally in the sliding bearings 78 and 79.

In the raised position, the shim plates (23 to 24) which are utilized to align or balance the upper edge of the lower working roll, can be successively and in paired relation brought beneath the hardmetal pressure or wear pieces 35 and 36 at the holding elements 10 and 11. This is done by way of the drive for the spindle 40.

Figure 4:
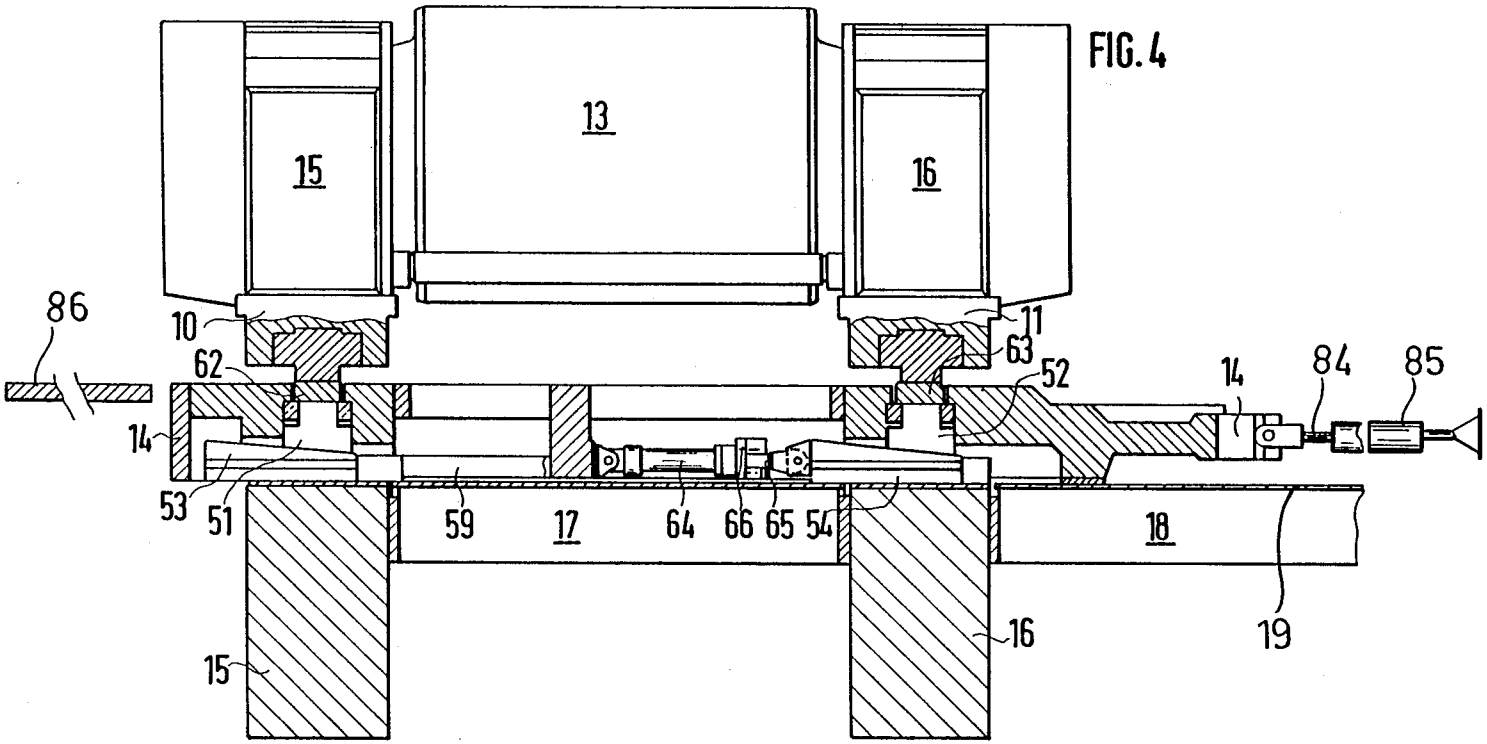
FIG. 4 is a longitudinal section through the roll change cart with two shim plates for adjusting the roll position.

With reference to FIG. 4, the lower portion of the four-high rolling mill frame has, in contrast to FIGS. 1 and 2, only two shim plates 62 and 63. These two shim plates 62 and 63 can be actuated, to be moved in the vertical direction, by the moveable wedge system (upper wedges 51 and 52), as has been described in detail above.

Thus, the actuating piston and cylinder unit 64 which is arranged between the lower wedges 53 and 54 is provided for their horizontal movement, with the wedges 53 and 54 being rigidly connected to one another by way of laterally provided connecting elements 59.

The actuating piston and cylinder unit 64 may be arranged atop the connecting elements 59 and can be connected thereto. The actuating piston and cylinder unit 64 is then supported at its other end in the frame or, as required, at a transverse strut of the cart 14.

At the piston rod 65 of the actuating piston and cylinder unit 64 is also provided a hydraulic clamp 66, or a similar protection means, to preclude damage of the cylinder of piston 64.

The system in which only one single shim plate 62, and 63 respectively, is used for each of the two holding elements 10 and 11, is particularly applicable when the rolls need only be raised through a small distance.

On the other hand, the shim plates 62 and 63 may be replaced by relatively thick plates. Accordingly, a quasi-infinitely variable height adjustment is achieved which extends beyond the vertical lift of a wedge system which includes the components 51 and 54.

Figure 5:
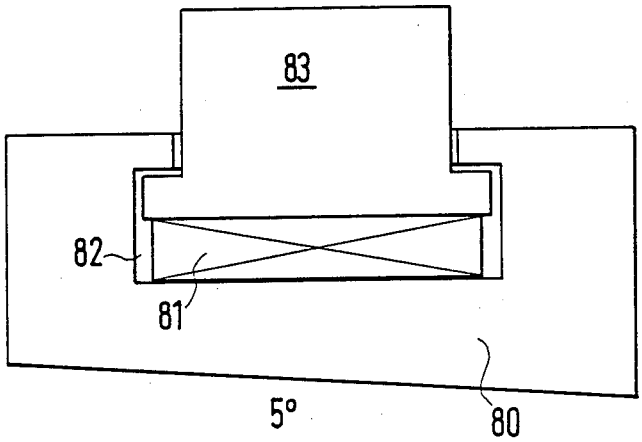
FIG. 5 is a schematic representation of the upper wedge with a pressure sensor, shown in cross section.

With particular reference to FIG. 5, the upper wedge 80 can be connected to a pressure sensor or cell 81. The pressure sensor 81 is imbedded in the recess 82 of the upper wedge 80, and a vertically moveable space piece 83 is arranged atop the pressure sensor 83.

The invention is not limited to the embodiments shown in the drawing. Thus, for example, the changing cart 14 or the method can be applied without limiting the scope of the invention to two-high or six-high rolling mills.

I claim:

1. A method of controlling working rolls of a rolling-mill stand having a pair of working rolls including a lower working roll journaled in a pair of lower-roll holding elements and a lower support roll beneath said lower working roll and journaled in a pair of support-roll holding elements, said method comprising the steps of:

(a) lifting the working and support rolls to position the upper surface of the lower working roll in a rolling plane by:

($a_1$) horizontally displacing a first wedge element on a roll-changing cart beneath each support-roll holding element to lift a respective second vertically displaceable wedge element and a respective shim of a plurality of individually liftable shims of a set of shims of stepped heights on said cart interposed between the respective second wedge element and support-roll holding element, ($a_2$) raising on said cart respective hydraulic-cylinder lifting elements into supporting position beneath said support-roll holding elements, and ($a_3$) selectively positioning between each of said second wedge elements and the respective support-roll holding element successive shims of the respective set until said upper surface is at said plane;

(b) lowering said rolls to cause said lower-roll holding elements to rest upon a fixed rail by;

($b_1$) supporting said support-roll holding elements on said hydraulic-cylinder lifting elements and then positioning the respective lowest-height shim of the respective set beneath the respective support-roll holding element, and ($b_2$) lowering said hydraulic-cylinder lifting elements to lower said support roll and said working rolls until said lower-roll holding elements come to rest on said rail; and (c) thereafter withdrawing said working rolls from said stand.

2. An apparatus for controlling the position of the upper surface of a lower working roll of a pair of working rolls above a lower support roll in a rolling-mill stand in which said support roll has support-roll holding elements positioned in openings of uprights on opposite sides of the stand, said apparatus comprising:

a horizontally shiftable roll-changing cart;

a respective horizontally shiftable lower wedge beneath each of said support-roll holding elements on said cart;

a respective vertically displaceable upper wedge on said cart having an inclined face slidably engaging a corresponding face of each lower wedge beneath each of said support-roll holding elements;

a respective movable set of shims of stepped heights on said cart selectively and successively insertable between each upper wedge and the respective support-roll holding element;

a horizontally shiftable frame on said cart receiving said sets of shims and provided with means for horizontally displacing said frame for positioning individual shims between each of said upper wedges and the respective support-roll holding element;

a horizontally reciprocatable hydraulic cylinder unit connected to both of said lower wedges to displace said lower wedges in one direction to raise said upper wedges and in an opposite direction to lower said upper wedges; and a respective pair of hydraulic-cylinder lifting elements on said cart on opposite sides of said frame in each of said openings and vertically adjustable to support the respective one of said support-roll holding elements during displacement of said frame to support said support-roll holding elements upon displacement of said lower wedges to lower the respective upper wedges.

3. The apparatus defined in claim 2 wherein said horizontally reciprocatable hydraulic cylinder unit is disposed between said lower wedges.

4. The apparatus defined in claim 2 wherein said horizontally reciprocatable hydraulic cylinder unit has a piston rod, said apparatus comprising a hydraulically operated clamp on said piston rod.

5. The apparatus defined in claim 2 wherein at least one of said upper wedges is provided with a pressure sensor and a spacer between said pressure sensor and a respective shim.

6. The apparatus defined in claim 2 wherein the difference in height of shims of successive heights of each of said sets is about 30 mm.

7. The apparatus defined in claim 2 wherein between said uprights parallel to said rolls a pair of roll-withdrawal rails are provided and the lowest-height shim of each set is of a height such that when said support-roll holding elements are supported thereon, lower-roll holding elements of the lower working roll rest upon said rails so that said working rolls can be withdrawn from said stand on said rails through one of said windows.

* * * * *